US008041268B2

(12) United States Patent
Takahashi et al.

(10) Patent No.: US 8,041,268 B2
(45) Date of Patent: Oct. 18, 2011

(54) DEVELOPING DEVICE, PROCESS CARTRIDGE, AND IMAGE FORMING APPARATUS

(75) Inventors: Tomoko Takahashi, Yokohama (JP); Yasuyuki Ishii, Machida (JP); Yoshinori Nakagawa, Yokohama (JP); Masaaki Yamada, Tokyo (JP); Ichiroh Kadota, Kawasaki (JP); Hideki Kosugi, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 583 days.

(21) Appl. No.: 12/170,930

(22) Filed: Jul. 10, 2008

(65) Prior Publication Data

US 2009/0016781 A1 Jan. 15, 2009

(30) Foreign Application Priority Data

Jul. 10, 2007 (JP) ..... 2007-181437

(51) Int. Cl.
*G03G 15/08* (2006.01)

(52) U.S. Cl. ..... 399/266; 399/291

(58) Field of Classification Search ..... 399/266, 399/265, 270, 285, 290, 291
See application file for complete search history.

(56) References Cited

U.S. PATENT DOCUMENTS

| | | | | |
|---|---|---|---|---|
| 5,860,040 | A * | 1/1999 | Shimizu et al. | 399/55 |
| 5,884,131 | A * | 3/1999 | Shimizu et al. | 399/270 |
| 6,658,227 | B2 | 12/2003 | Oyama et al. | |
| 7,313,336 | B2 | 12/2007 | Kadota et al. | |
| 7,340,204 | B2 | 3/2008 | Nakazato et al. | |
| 2006/0088337 | A1 * | 4/2006 | Nakazato et al. | 399/116 |
| 2006/0216071 | A1 | 9/2006 | Yamada et al. | |
| 2006/0251449 | A1 | 11/2006 | Takahashi et al. | |
| 2007/0013924 | A1 | 1/2007 | Sakai et al. | |
| 2007/0015071 | A1 | 1/2007 | Tsukamoto et al. | |
| 2007/0086811 | A1 | 4/2007 | Tsukamoto et al. | |
| 2007/0212121 | A1 | 9/2007 | Takahashi et al. | |
| 2007/0242985 | A1 | 10/2007 | Aoki et al. | |
| 2008/0124138 | A1 | 5/2008 | Kosugi et al. | |

FOREIGN PATENT DOCUMENTS

| | | |
|---|---|---|
| JP | 3-21967 | 1/1991 |
| JP | 3-100575 | 4/1991 |
| JP | 3-113474 | 5/1991 |
| JP | 9-269661 | 10/1997 |
| JP | 2002-341656 | 11/2002 |
| JP | 2003-15419 | 1/2003 |
| JP | 2003-84560 | 3/2003 |
| JP | 2004-101933 | 4/2004 |
| JP | 2004-286837 | 10/2004 |

OTHER PUBLICATIONS

U.S. Appl. No. 12/205,314, filed Sep. 5, 2008, Nakagawa, et al.
U.S. Appl. No. 12/205,240, filed Sep. 5, 2008, Takahashi, et al.

* cited by examiner

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

A developing device comprises a latent image carrier that carries a latent image, a toner carrier opposing the latent image carrier while carrying toner to develop the latent image, and plural electrodes arranged in a prescribed direction insulated from each other on the surface of the toner carrier to create an electric field therebetween. An alternating voltage supplying device is provided to supply n number of phases (n ≧2) of an alternating voltage to the plural electrodes, respectively. The alternating voltage changes the electric field to cause the toner to hop and form toner cloud on the surface of the toner carrier. The toner hopping is halted at a prescribed time period during the toner cloud formation.

20 Claims, 12 Drawing Sheets

DUTY · · · T1 × m/T2 (RATE OF TURNING ON TIME OF FLARE)

FIG. 19A

| FREQUENCY [kHz] | NIP WIDTH [mm] |
|---|---|
| 0. 1 | 5 |
| 1 | 8. 7 |
| 3 | 10 |
| 4 | 10. 8 |
| 5 | 11 |

FIG. 19B

| FREQUENCY [kHz] | LINE ADHESION STATE |
|---|---|
| 0. 1 | SAME AS SOLID SECTION |
| 1 | SAME AS SOLID SECTION |
| 3 | SEEM DARKER THAN SOLID SECTION |
| 4 | SEEM DARKER AND MORE RISING THAN SOLID SECTION |
| 5 | SEEM DARKER AND MORE RISING THAN SOLID SECTION |

FIG. 19C

| CONDITIONS | T1 [ms] | NUMBER OF TIMES m | T2 [ms] | LINE ADHESION STATE |
|---|---|---|---|---|
| 1 | 0. 2 | SUCCESSION | | SEEM DARKER AND MORE RISING THAN SOLID SECTION |
| 2 | 0. 2 | 5 | 10 | SAME AS SOLID SECTION |
| 3 | 0. 2 | 20 | 10 | NO PROBLEM EVEN SEEMING SLIGHTLY DARKER THAN SOLID SECTION |
| 4 | 0. 2 | 20 | 5 | SEEM DARKER AND MORE RISING THAN SOLID SECTION |
| 5 | 1 | 3 | 10 | SAME AS SOLID SECTION |

FIG. 19D

| CONDITIONS | h |
|---|---|
| 1 | 556 |
| 2 | 56 |
| 3 | 222 |
| 4 | 444 |
| 5 | 33 |

DEVELOPING DEVICE, PROCESS CARTRIDGE, AND IMAGE FORMING APPARATUS

CROSS REFERENCE TO RELATED APPLICATION

This application claims priority under 35 USC §119 to Japanese Patent Application No. 2007-181437 filed on Jul. 10, 2007, the entire contents of which are herein incorporated by reference.

BACKGROUND OF THE INVENTION

1. Field of the Invention

The present invention relates to a developing device for developing a latent image formed on a latent image carrier, a process cartridge integrally including the developing device, and an image forming apparatus, such as a printer, a facsimile, a plotter, a multifunctional machine including one of the functions of these devices, including one of the process cartridge and the developing device.

2. Background of the Invention

In the past, a developing device employed in an image forming apparatus, such as a printer, a facsimile, a plotter, etc., employs one or two-component developing system. The two-component developing system is very suitable for high speed developing, and is mainly employed in a middle or high-speed image forming apparatus. To obtain a high quality image using the two component developing system, developer needs to be extra ordinarily accurate at a section contacting a latent image formed on the latent image carrier. Thus, a diameter of a carrier particle is decreasing these days, and carrier having a diameter of about 30 micrometer recently comes to be used on a commercial basis.

Since a mechanism can be downsized and lightened, the one component developer is mainly used currently in a low speed image forming apparatus. To form a thin toner layer on a developing roller in the one component developing system, a toner-adjusting member, such as a blade, a roller, etc., contacts toner on the developing roller, so that the toner is discharged by means of friction created between the developing roller and the toner adjustment member. Such a discharged toner thin layer on the developing roller is conveyed to a developing section and develops the latent image on a latent image carrier. A developing system employed here is categorized into two of contact and non-contact types, wherein the former represents that a developing roller contacts a latent image carrier, and the latter does not. As shown in the Japanese Patent Application Laid Open No. 03-100575, to complement defects of the two and one component developing systems, a hybrid system blending these two and one component developing systems has been proposed.

A method of developing a fine uniform dot with high resolution is disclosed in the Japanese Patent Application Laid Open No. 03-113474. The method employs the above-mentioned hybrid system and arranges a wire to which a high cycle bias is applied at a developing section, and causes toner clouding there, so that a dot developing performance is obtained with high resolution. The Japanese Patent Application Laid Open No. 03-21967 proposes a method of forming an electric field curtain on a roller to most efficiently and stably forming toner clouding. The Japanese Patent Application Laid Open No. 2003-15419 discloses a developing device for conveying developer by means of an electric field curtain formed by a traveling wave electric field. The Japanese Patent Application Laid Open No. 9-269661 discloses a developing device including plural magnetic poles, which almost equally attract almost one layer of carrier onto the periphery of a developing roller.

The Japanese Patent Application Laid Open No. 2003-84560 discloses a developing device that periodically (or intermittently) includes plural conductive electrode patterns on the surface of a developer carrier member that carries non-magnetic toner via an insulation section, and causes an inclination of an electric field in the vicinity of the surface of the developer carrier member when a prescribed bias voltage is applied to the electrode, so that the non-magnetic toner is conveyed being attracted to the developer carrier member.

A high quality image is increasingly demanded in the two component developing system. Thus, since a dot size of a pixel is necessarily equal or smaller than a diameter of a currently used carrier particle, the currently use carrier particle further needs to be downsized in view of a reproduction performance of an isolated dot. However, when the carrier diameter is decreased, a magnetic permeability of the carrier particle decreases. As a result, the carrier easily drops off the developing roller. When the dropped carrier particle sticks to the latent image carrier member, not only an image is defective due to toner sticking, but also side effects, such as damaging the latent image carrier member, etc., occur thereafter.

To prevent the carrier drop, many attempts have been made in a view point of material, such as increasing a magnetic permeability of carrier particle, intensifying a force of magnet installed in a developing roller, etc. However, since it is difficult to obtain a high quality image at low cost, development hardly is progressed. In view of a current demand for downsizing, a diameter of a developing roller is increasingly decreased steadily, designing of a developing roller having a strong magnetic field capable of completely suppressing carrier drop becomes difficult. From the beginning, since the two component developing system forms a toner image by rubbing ear of the two-component developer called a magnetic blush, development of an isolated dot tends to be uneven due to un-uniform ear. It is possible to improve an image quality by forming an alternating electric field between a developing roller and a latent image carrier member. However, image unevenness caused by uneven developer ear can hardly be removed completely.

In the one component developing system, since a toner layer thinned by a toner adjustment member on a developing roller has already been pressure contacted the developing roller, a response of the toner to an electric field is extremely slow at the developing section. Thus, forming an intense alternating current field between a developing roller and the latent image carrier is common to obtain a high quality image. However, it is still difficult to develop a latent image with a constant amount of toner, and to uniformly develop a fine dot with high resolution. Further, since the one component developing system causes extremely large stress in toner when the toner layer is thinned on the developing roller, the toner quickly deteriorates during circulation through the developing device. As the toner deteriorates, the toner layer is easily unevenly thinned on the developing roller. Accordingly, the one component developing system is generally not preferable for a high speed and durable image forming apparatus. Even a size and a number of parts of a developing device of a hybrid system increase, some problems can be resolved. However, the developing section also includes the same problem as that using the one component developing system. That is, it is difficult for it to develop a fine and uniform dot with high resolution.

The system of the Japanese patent Application Laid Open No. 03-113474 can realize highly stable and high quality development. However, the developing device becomes complicated. The system of the Japanese patent Application Laid Open No. 3-21967 is significantly excellent in obtaining downsized and high quality image. However, conditions for an electric field curtain and development are too strict to obtain an ideal high quality image. Specifically, when an image is formed on a wrong condition, an expected result does not occur, and a bad quality image is rather provided.

Further, in an image forming process that sequentially superimposes first to third toner images on a latent image carrier, a developing system is needed not to disturb a toner image already formed thereon. By employing either a non-contact type one component developing system or the toner cloud developing system as described in the Japanese Patent Application Laid Open No. 03-113474, respective color toner image can be subsequently formed on the latent image carrier. However, since an alternating current electric field is necessarily formed between the latent image carrier and the developing roller in the both systems, the toner image previously formed on the latent image carrier is partially peeled off and enters the developing device. As a result, an image on the latent image carrier is not only disturbed, but also colors of the toner in the developing device are blended. Such a problem is fatal in creating a high quality image. Thus, the cloud developing is to be realized while the alternating current electric field is not created between the latent image carrier and the developing layer to resolve such a problem.

As a cloud development-realizing method, a system described in the Japanese patent Application Laid Open No. 03-21967 can be effective. However, as mentioned earlier, the method needs to be used under the strict condition, or any of the expected result is not obtained. Further, as described in the Japanese Patent Application Laid Open No. 2002-341656, a method of electro-statically conveying toner using an alternating electric field having more than three phases while omitting mechanical driving for a toner carrier member can be effective. However, this method includes a problem of toner accumulation on a conveyance substrate triggered by toner impossible to electro-statically convey due to some reason. To resolve such a problem, a structure of a secured conveyance substrate and a toner carrier member that moves along the surface of the secured conveyance substrate has been proposed as discussed in the Japanese patent Application Laid open No. 2004-286837. However, a mechanism becomes extremely complex.

In the cloud developing, it is significantly important to obtain sufficient image density avoiding background contamination. The Japanese patent Application Laid Open No. 2004-101933 proposes that when development is executed while forming an advancing wave electric field, an amount of conveyance is controlled by adjusting a frequency of a conveyance voltage or the like. Since the method only adjusts an amount of toner existing in the developing region, and the idea is the same as conventional one or two component development, and accordingly doesn't adjust a clouding condition, it is difficult to control toner uniquely having a weak binding force in the cloud. Thus, a range capable of obtaining sufficient image density without background stein is significantly narrow, or is not obtained depending upon a cloud condition.

SUMMARY OF THE INVENTION

The present invention has been made in view of the above noted and another problems and one object of the present invention is to provide a new and noble developing device that comprises a latent image carrier that carries a latent image, a toner carrier opposing the latent image carrier while carrying toner to develop the latent image, and plural electrodes arranged in a prescribed direction insulated from each other on the surface of the toner carrier to create an electric field therebetween. An alternating voltage supplying device is provided to supply n number of phases ($n \geqq 2$) of an alternating voltage to the plural electrodes, respectively. The alternating voltage changes the electric field to cause the toner to hop and form toner cloud on the surface of the toner carrier. The toner hopping is halted at a prescribed time period during the toner cloud formation In another embodiment, the alternating voltage is supplied a prescribed times "m" in a cycle T1 per cycle T2 while meeting the below described relation;

$$T2>T1\times m.$$

In yet another embodiment, the relation is established when a prescribed point on the surface of the latent image carrier passes through a developing nip where the latent image carrier and toner carrier oppose each other to execute development.

In yet another embodiment, 4. The developing device as claimed in claim 2, wherein said n number of phases of the alternating voltage are different from each other and generated at the same time.

In yet another embodiment, the below described relation is established, wherein r represents a width of a developing nip where the latent image carrier and the toner carrier oppose each other to develop the latent image in a moving direction of the latent image carrier, and Vp represents a line speed of the latent image carrier;

$$r/Vp=h\times 1/n\times T2/m(1<h<400).$$

In yet another embodiment, the value h meets the following inequality;

$$1<h<300.$$

In yet another embodiment, the interval (T2−T1×m) is not shorter than a toner hopping average time period when toner peeled off a prescribed electrode sticks to the other electrode.

In yet another embodiment, the below described inequality is met;

$$T1\times m/T2\times 100<50.$$

In yet another embodiment, the below described inequality is met;

$$T1\times m/T2\times 100<40.$$

In yet another embodiment, the below described inequality is met, wherein Vmax(v) represents an absolute value of a voltage difference between the neighboring electrodes, and p (micrometer) represents an interval between the neighboring electrodes in a moving direction of the latent image carrier;

$$V\max/p>1.$$

In yet another embodiment, the below described inequality is met, wherein d represents a distance between the latent image carrier and the toner carrier in the developing nip, and p (micrometer) represents an interval between the neighboring electrodes in a moving direction of the latent image carrier;

$$d>p$$

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 19A is a table illustrating an exemplary relation between a switching frequency and a nip width measured according to one embodiment of the present invention;

FIG. 19B is a table illustrating exemplary assessment of a relation between the switching frequency and a toner adhesion condition according to one embodiment of the present invention;

FIG. 19C is a table illustrating an exemplary result of an experiment executed by changing voltage applying cycles and times according to one embodiment of the present invention; and FIG. 19D is a table illustrating an exemplary relation between a condition and a switching number of times according to one embodiment of the present invention.

PREFERRED EMBODIMENTS OF THE PRESENT INVENTION

Figure 1:
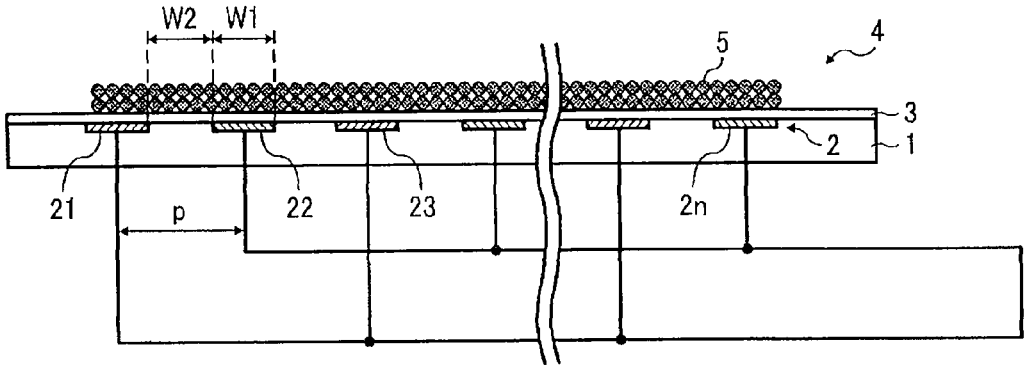
FIG. 1 illustrates an exemplary system used in an experiment according to the present invention.

Referring now to the drawings, wherein like reference numerals and marks designate identical or corresponding parts throughout several figures, in particular, in FIG. 1, an experiment executed before the present invention is made is initially described. As shown, by depositing aluminum on a glass substrate 1, an electrode pattern 2 including plural electrodes 21, 22, 23, etc., arranged in a moving direction of a latent image carrier at an interval p (micrometer) is formed. A resin coat 3 having a thickness of about 3 micrometer and a cubic resistance of about $10^{10}$ (Ohm×cm) is formed on the electrode pattern 2 as a protection layer, so that a substrate 4 is formed as a toner carrying member. A toner layer 5 is formed overlying the substrate 4.

Figure 2:
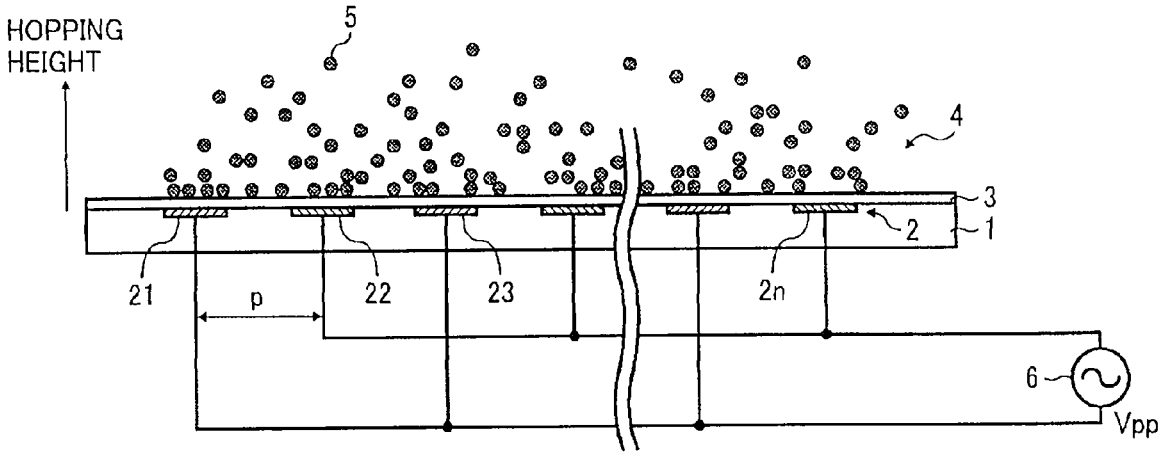
FIG. 2 illustrates an exemplary flare condition of the system of FIG. 1.

A thin toner layer 5 is formed by developing a solid image on the substrate 4 using a two-component developing member, not shown. Polyester toner having a particle diameter of about 6micrometer is used. An amount of discharge of toner in the thin layer on the substrate 4 is about −22 (micro C/g). As shown in FIG. 2, when an alternating current power source 6 serving as a voltage supplying device applies an alternating current voltage to an odd number electrode group including odd number electrodes 21, 23, etc., and that having an opposite phase to an even number electrode group including even number electrodes 22, 24, etc., respective toner of the toner layer 5 reciprocate between these odd and even number electrode groups as a popping motion. A status of such a popping motion is called hereinafter flare. In other words, the flare represents a condition in which toner cloud is created while toner is peeled off from the surface of the substrate 4 under the influence of an electric field.

Figure 3:
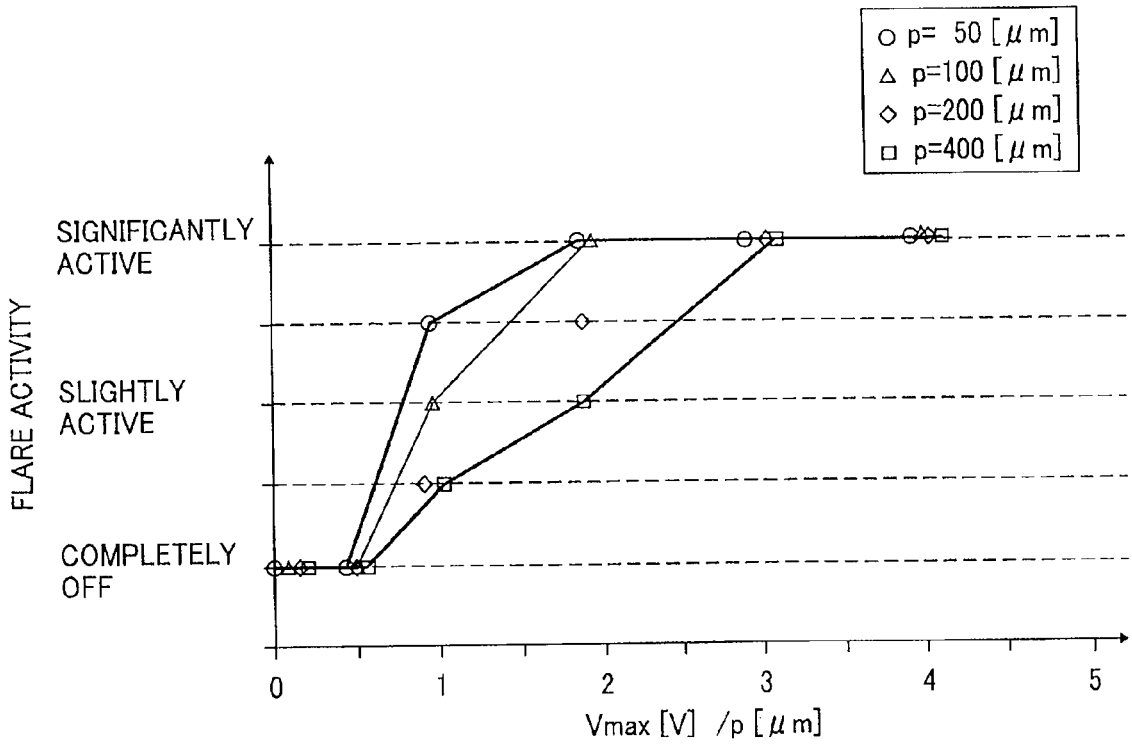
FIG. 3 illustrates an exemplary relation between a Vmax (V)/p(micrometer) and a flare activation degree as an experiment result of the system.

By using four different substrates 4 each having electrodes 21, 22, and so on arranged at intervals of 50, 100, 200 and 400 micrometer, respectively, and changing, few times, an absolute value Vmax(V) as a difference between plus and minus peaks of an alternating current voltage applied from the alternating current source 6 to the electrodes 21, 22, and so on, a flare active level is observed using a high-speed camera. The observation result is described in FIG. 3. The width w1 of the electrodes 21, 22 and so on, and the distance w2 between neighbors of these electrodes amounts to a half of the interval of the electrodes 21, 22, and so on.

The flare active degree is obtained by observing a condition of toner stably sticking to the surface of the substrate 4 and is represented by about five ranks according to a sensual evaluation. From FIG. 3, it is confirmed regardless of the values of Vmax and p that the flare active degree can always be calculated by the following formula;

$$\text{Vmax(V)/p(micrometer)}.$$

Further, it is understood that the flare starts being active when the following inequity is established;

$$V\text{max}(V)/p(\text{micrometer})>1.$$

Whereas the flare is completely active when the following inequity is established;

$$V\text{max}(V)/p(\text{micrometer})>3.$$

However, it is realized that the background stein occurs, and accordingly a fine image is not always obtained even if toner on the flare substrate is sufficiently active. To investigate causes thereof, a toner cloud condition is observed using a high-speed camera, while fixing the values Vmax and p to levels capable of sufficiently obtaining the activation but changing a frequency. It was found that when the frequency is low, the toner on the electrode repeatedly hops and sticks to a neighboring electrode due to switching of the voltage, while motion of toner hopping is relatively the same. When the frequency is increased, it is recognized that even though the toner hops due to switching of the voltage, the hopped toner partially remains not sticking to the neighboring electrode at the next voltage switching, and becomes impossible to follow the subsequent voltage switching, so that the toner hopping movement becomes disturbed. Since the condition for toner hopping disturbance accords with that of occurrence of background stein, it is understood that toner insufficiently controlled by the electric field contributes to the background stein when toner hopping is disturbed.

Figure 4:
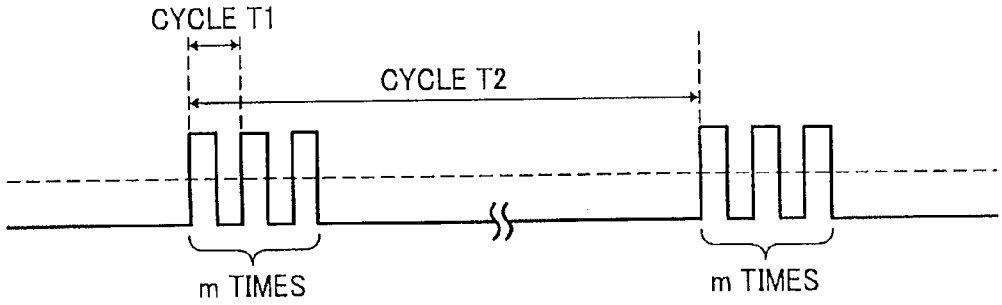
FIG. 4 illustrates an exemplary time when an alternating voltage is applied according to one embodiment of the present invention.

However, in proportion to a number of switching times of an applied voltage, intended image density can be readily obtained. Whereas if a low frequency is simply used, an image having sufficient density is hardly obtained. Thus, suppression of toner hopping and obtaining image density at same time becomes a problem to be solved. According to the present invention, a time interval is provided to calm down the toner hopping disturbance caused due to excessive frequency of voltage switching and prevent the background stein while acquiring image density. Specifically, it is attempted to decrease a chance when toner becomes out of control of the electric field by temporarily halting hopping of the toner when toner hopping is disturbed. Specifically, two phases of the voltage shown in FIG. 4 are applied. Although a waveform of one phase is only illustrated in FIG. 4, the two phases of waveforms are vertically provided line symmetry. Specifically, an alternating current voltage having two different phases alter at the same time with a different phase. This voltage repeatedly alters in a cycle T1 m-times per cycle T2 having a prescribed time period. By applying per the cycle T2, the toner hopping calms down, and is under control. Thus, by repeating the alternation of the voltage having the cycle T1 m-times, sufficient image density can be obtained.

The interval (T2−T1×m) represents a hopping halt time period for toner, and is set longer than an average hopping time period needed when toner is peeled off from an electrode to when the toner peeled off sticks to another electrode. The toner hopping represents behavior of toner that is peeled off from a first electrode and reaches a neighboring second or a third electrode close to the second one. The average hopping time period represents an average time period taken by thus moving toner. Because of setting of the toner hopping halt time period to the value T2−T1×m, toner is suppressed to become out of control of the electric field. Thus, by alternating the voltage in the cycle T1 prescribed times (e.g. m times) per prescribed time period T2, a cloud state becomes controllable.

Figure 5:
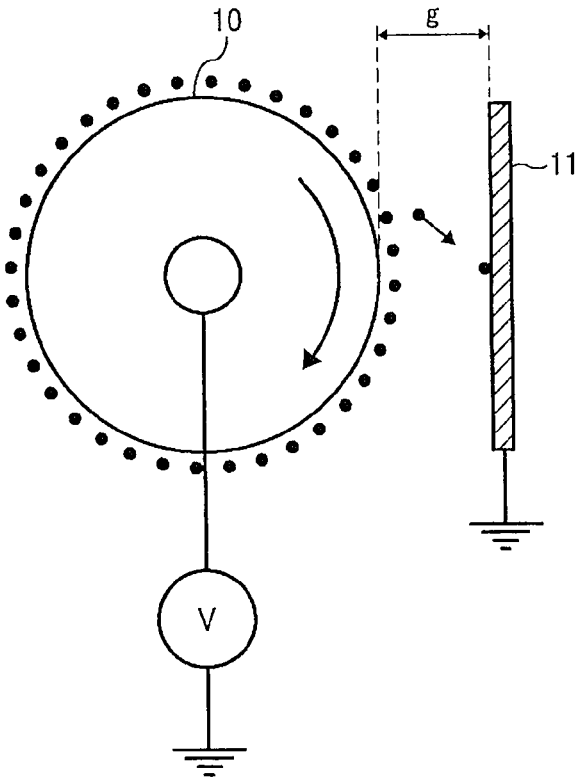
FIG. 5 illustrates an exemplary experimental system for investigating occurrence of dust toner.

Now, a relation between a cycle T1, a number of times m, a cycle T2, and a cloud control performance is investigated. As an index of the cloud control performance, an amount of toner floating and hopping without sticking to a neighboring electrode is investigated among those hopping from an electrode. The amount of hopping toner is obtained by measuring an amount of toner sticking to an electrode arranged sufficiently far from a flare electrode (i.e., electrodes 21, 22, and so on). An experiment system is now described with reference to FIG. 5. As shown, a metal plate 11 is opposed to a developing roller 10 (which is a roller type substrate 4 and corresponds to the later mentioned toner carrying member) as a dust toner-capturing member. A diameter of a developing roller 10 is 30 mm, and the metal plate 11 has an area of 30 mm×30 mm. The developing roller 10 and the metal plate 11 are closely arranged to easily evaluate a level via a gap 9 of about 5 mm. A prescribed bias is applied so that a differential voltage of +50V appears on the metal plate 11 in relation to the center of an alternating voltage applied to the developing roller 10. Specifically, for the purpose of easy level evaluation, such an electric voltage difference enables the toner to easily stick to the metal plate. Specifically, under the following conditions, a measurement is executed while the developing roller is rotated at a line speed 180 mm/s for 30 seconds.

Developing roller: Vpp 400
Central Voltage: −50V
Metal plate: grounded

Toner incapable of following voltage switching deviated from a flare region (i.e., an electric field control section) floats and receives influence from an electric field existing in the vicinity of the metal plate 11, thereby sticking to the metal plate 11 as dust toner.

Figure 6:
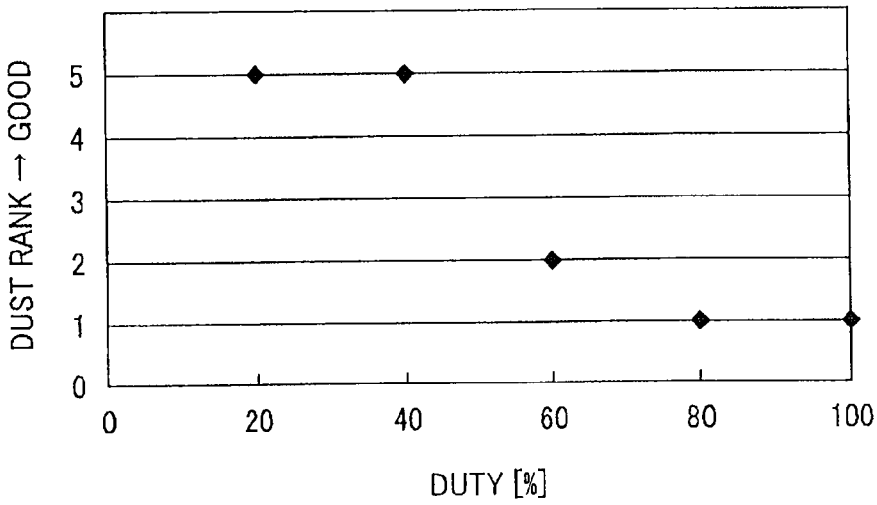
FIG. 6 illustrates an exemplary relation between a dust rank and a duty.

The measurement result is illustrated in FIG. 6, in which a lateral axis represents a ratio (T1×m/T2 (i.e., Duty)) of a time period when a voltage of a cycle T1 is applied in relation to the entire time period. As shown, an amount of dust toner is plotted in the vertical axis direction. Since it almost becomes equivalent to application of a continuous alternating voltage when the duty exceeds 50%, 30% or 40% duty is preferable to obtain a prescribed effect.

Because solid and line images are not uniformly developed in a condition where toner on the flare substrate 4 is sufficiently active, uniformity of an image and a developing nip are considered to direct attention to development in a developing section. Specifically, even though an amount of toner sticking to a solid image on a photoconductive member is appropriate, an amount of toner sticking to a line image is excessive. Thus, when an image is printed through transfer and fixing processes, an image deteriorates due to dust or the like. The developing nip is defined by a hopping height of toner T conveyed on the substrate 4 and a gap between the substrate 4 and a photoconductive member, not shown. That is, a range where the gap is smaller than the hopping height is recognized as the developing nip. Since the hopping height varies in accordance with an applied voltage, a value Q/m of toner, a width of an electrode or the like, a practical developing gap is obtained by an experiment. A width of a developing nip is measured by the following manner.

As to a developing performance obtained when a continuous bias is applied to the electrode, conditions of an electrode, an electrode to a photoconductive member, and a toner conveyance amount or the like are the same as practically employed and the photoconductive member is arranged opposing a flare roller (i.e., the substrate 4) and is rotated at a constant speed. The voltage of the photoconductive member is changed while applying a flare voltage (a voltage applied to electrodes 21, 22, and so on) to a flare roller and thereby keeping the toner hopping. The photoconductive member has a voltage of a non-image portion in the standby state, and that of an image portion in a turn on state. The toner sticks to the photoconductive member from a flare roller during turning on. Thus, by changing the turn on time period, the toner sticks to the photoconductive member with a width corresponding to the turn on time period. The toner sticking width is measured, and a value at a point where t=0 on a line extending between respective plots plotted per turn on time is regarded as the nip width. It was found that a prescribed relation needs to be established among parameters of a developing nip width "r", a line speed Vp of a photoconductive member, a frequency "f" of a drive voltage, and a phase number "n" to obtain preferable toner sticking to the photoconductive member while avoiding unevenness thereof caused by an excessive sticking An experiment manner is as as follows. Electrodes having a width of 40 micrometer arranged at an interval of 40 micrometer are employed. An average of a voltage pulse to be applied to the electrodes is about −350V, and the value Vpp is about 400V. The electrodes are formed on the surface of a roller rotated with its line speed equivalent to that of the photoconductive member. A line latent image is formed having about −500V at a non-image section, and about −100V at an image section.

By changing a frequency and observing toner on the photoconductive member, an amount of sticking toner is measured. By dividing the sticking amount thus measured by an area of a line, a sticking amount per area is calculated. The developing nip width is measured by the above-mentioned manner. The nip width varies in accordance with a frequency, and prescribed measurement values of the nip at the frequency are obtained as shown in a table of FIG. 19A.

Then, experiments are performed at respective frequencies. A process line speed is 180 mm/s and the photoconductive member and the flare roller rotate at a constant speed. It is the same when the process line speed is 360 mm/s. A result of evaluation of a sticking condition in relation to a frequency is described in a table of FIG. 19B Base on this result, it is understood that occurrence of lot of hopping and directing of excessive developing toner to a latent image when passing through the developing region are causes of sticking of excessive toner to a line latent image. Thus, it is also understood that there exists a relation to a number of hopping times within the time passing through the developing region. To support this understanding, another experiment is executed while increasing the process speed twice. As a result, some improvement is recognized. This relation is calculated by the following formula wherein r represents a developing nip width, Vp represents a line speed of a photoconductive member, f represents a frequency of a drive voltage, and n represents a phase number;

$$r/Vp=h\times 1/n\times 1/f. \quad (1)$$

Figure 7:
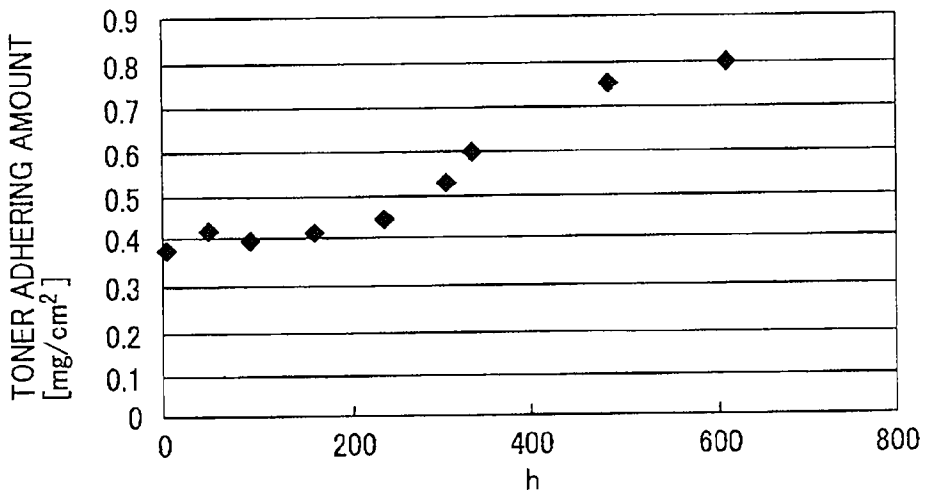
FIG. 7 illustrates an exemplary relation between a number of alternating times of a level of several hundreds and an amount of sticking toner.

Thus, by determining a parameter h corresponding to a number of switching times, the condition of line developing can be identified. Experiments are further performed on conditions where process speeds are changed to 180 mm/s and 360 mm/s while also changing a frequency from 0.1 to 5 kHz, respectively, and an amount of toner sticking to a line is measured. It was found that an amount of toner sticking to a solid section is about 0.4 mg/cm$^2$. The result of the experiment is illustrated in FIG. 7 where a horizontal axis represents the parameter h of the formula (1)

As shown, in a region where the value h is relatively small, a line sticking amount does not largely increases, and excessively sticks when the value h relatively increases. It is understood that the line sticking amount is preferable when the value h is not larger than 400, and is more preferably where it is not larger than 300. It is recognized that to obtain sufficient image density, the value h is not less than 1.

A further experiment is performed to confirm if the same phenomena occurs when the voltage is applied in a cycle T1 m times per cycle T2. A result is illustrated on a table of FIG. 19C.

Since a process line speed employed in this embodiment is about 180 mm/s, and a nip width is about 8 to 10 mm, a value of the repetitious number h is calculated premising that the nip width is 10 mm. The respective values h obtained in relation to respective conditions 1 to 5 are listed on a table as shown in FIG. 19D.

The same result is seen when these values h are plotted on the graph of FIG. 7.

A formula representing a condition for a number of switching times h when an applied voltage is switched according to the present invention is established by the following formula:

$$r/Vp=h\times 1/n\times T2/m. \quad (2)$$

Figure 8:
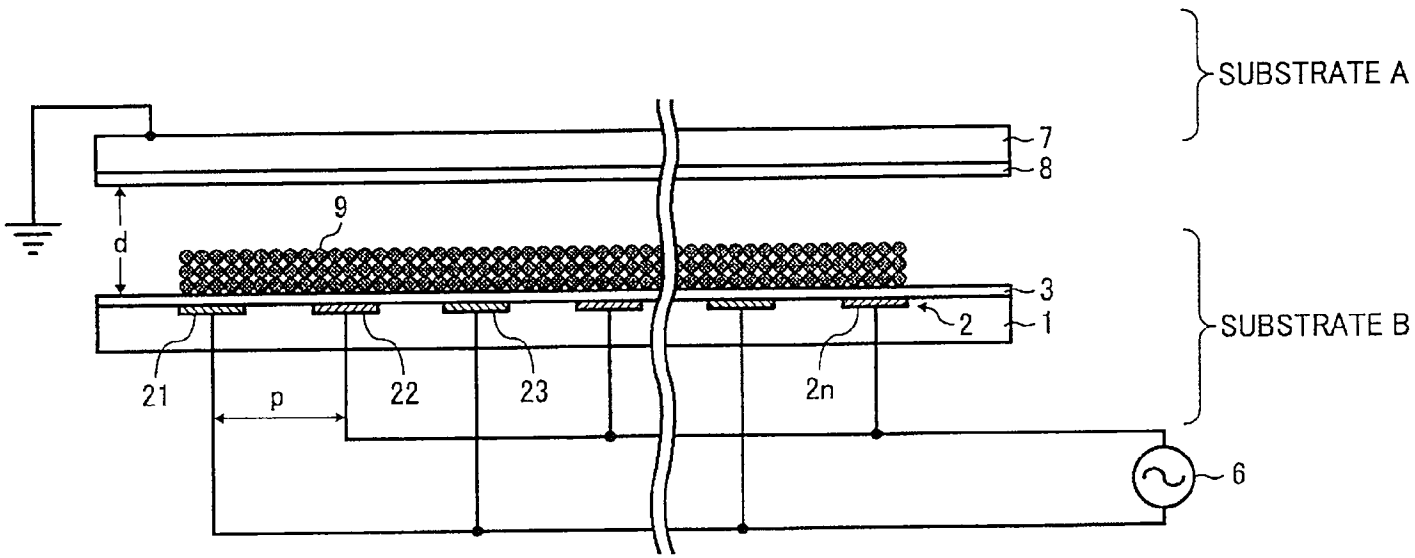
FIG. 8 illustrates an exemplary system used in an experiment for finding out a relation between a number of alternating times and a development rate.

Further, when an experiment is performed by changing a distance d between the latent image carrier and the toner-carrying member, uneven image having a different appearance is recognized at a closer distance than that in the above-mentioned experiment. This unevenness accords with an interval between electrodes, and a toner-sticking amount is considered to change in accordance with intensity of an electric field on an electrode pattern. Such a phenomena occurs when the electrode interval p is not smaller than the distance d. Thus, it is efficient when the electrode interval p is not larger than the distance d to help prevent unevenness of the interval caused by the electrode. To confirm this result, an experiment is performed using a flat plate electrode as shown in FIG. 8. Initially, a toner layer 9 is formed by means of two-component development on a substrate 1 having the same configuration as that described with reference to FIG. 1. Voltages having opposite phases are applied to the respective even number electrodes 22, 24, and so on, as well as the odd number electrodes 21, 23, and so on.

Figure 9:
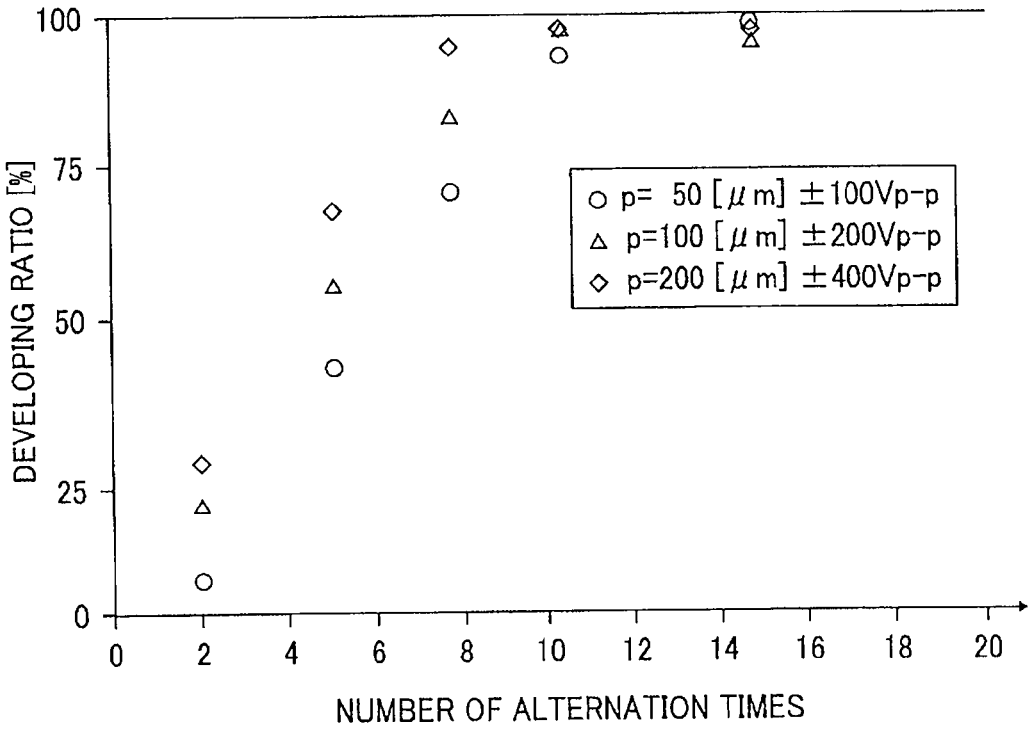
FIG. 9 illustrates an exemplary relation between a number of alternating times and a development rate as an experiment result of the system.
Figure 10:
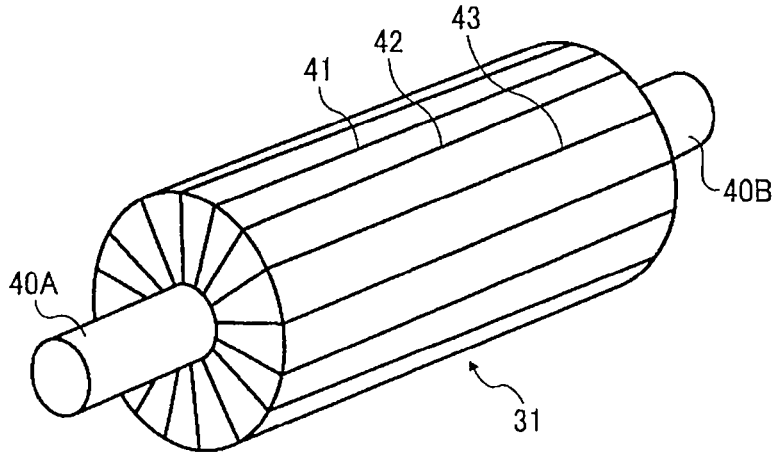
FIG. 10 illustrates an exemplary typical example of a toner-carrying member used in one embodiment of the present invention.

An opposing electrode 7 is grounded and an insulation layer 8 is formed on the opposing surface. The grounded electrode 7 is offset by a central value of an alternating voltage to a level capable of attracting the toner. Thus, the toner is attracted to the electrode side. When a toner polarity is negative, a negative voltage is offset. When both are opposed via a prescribed air gap while an alternating voltage is applied, a toner layer partially sticks to the electrode 7. A ratio of mass of toner sticking to the opposing surface due to application of the alternating voltage previously created in relation to the toner-sticking amount is regarded as a development rate. An experiment is then performed while changing both of a cycle of an alternating voltage to be applied and a number of alternation times. An amount of toner previously sticking to a photoconductive member is about 0.4 to 0.6 g/cm$^2$. The result of the experiment is described in FIG. 9. The result of FIG. 9 is obtained when an applied voltage frequency is about 1 kHz. However, the same result was obtained when the frequency is from about 0.1 to about 3 kHz. Specifically, it is found that more than 90% development rate is obtained by ten times of alternation regardless of a change in frequency.

Figure 11A:
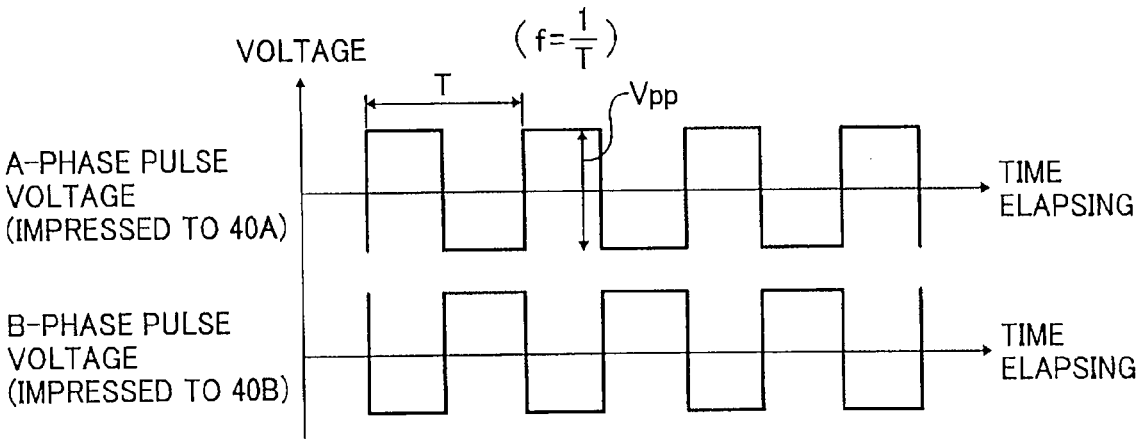
FIGS. 11A and 11B collectively illustrate a performance of a pulse voltage applied to an electrode for the toner-carrying member.
Figure 11B:
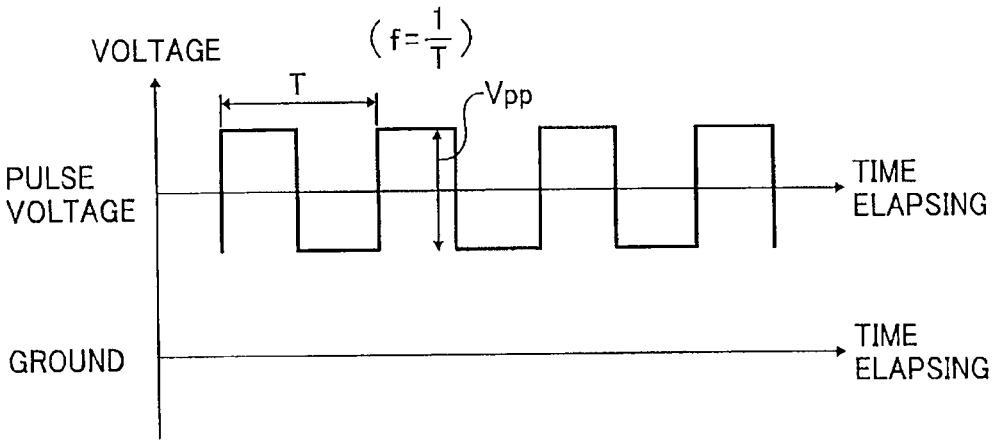

Now, an exemplary toner-carrying member used in one embodiment of the present invention is described. The toner-carrying member (hereinafter referred to as a toner carrying roller) 31 is a roller shape. An electrode pattern is formed thereon including plural electrodes 41, 42, and so on, arranged with an interval of p (micrometer) in a movement direction at a prescribed space frequency. The toner carrying member is enabled to rotate around electrode shafts 40A and 40B binding an odd number electrode group formed from assembles of odd number electrodes and even number electrode group formed from assembles of even number electrodes, respectively. To each of the respective electrode shafts 40A and 40B, an alternating voltage is applied from an alternating current power source as a bias voltage by means of an electrode brush or the like, not shown. As shown in FIG. 1A, a rectangular wave of an alternating current voltage is applied to the electrode shaft 40A binding the odd number electrode group. Whereas to the electrode shaft 40B binding the even number electrode group, a voltage having a rectangular wave including an opposite phase is applied. An average voltage is the same to each other. Further, as shown in FIG. 11B, the same result can be obtained even if an alternating current voltage having a rectangular wave is applied and a direct current voltage having the average voltage of the alternating current voltage is applied.

Figure 12A:
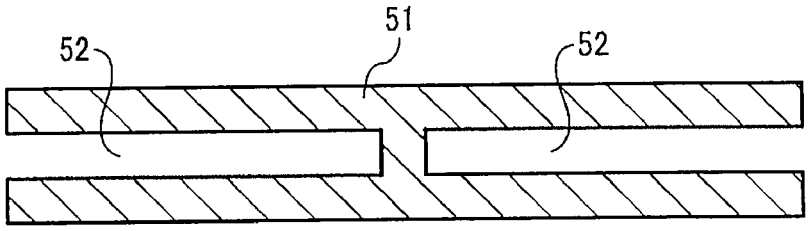
FIGS. 12A, 12B, and 12C collectively illustrate a part of an exemplary manufacturing process for manufacturing the toner-carrying member.
Figure 12B:
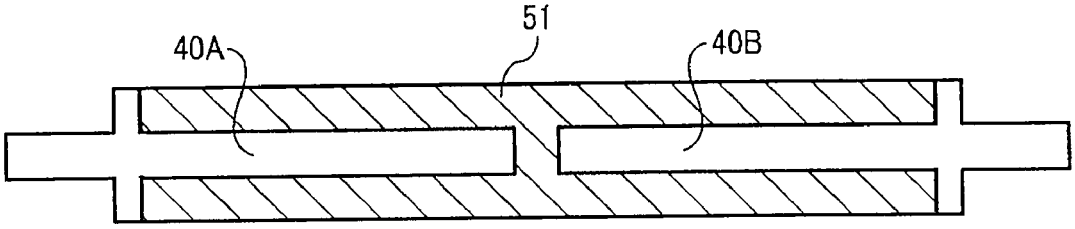
Figure 12C:
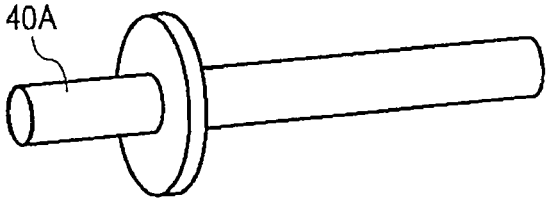
Figure 13A:
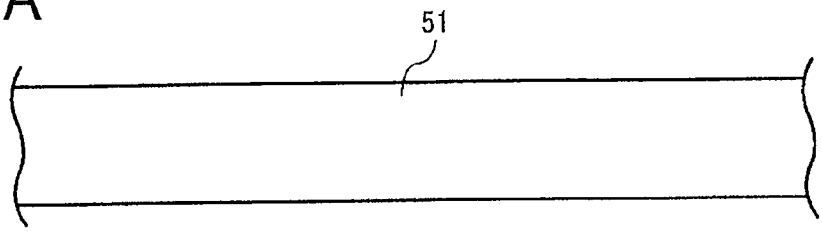
FIGS. 13A through 13E collectively illustrate another exemplary manufacturing process for manufacturing the toner-carrying member.
Figure 13B:
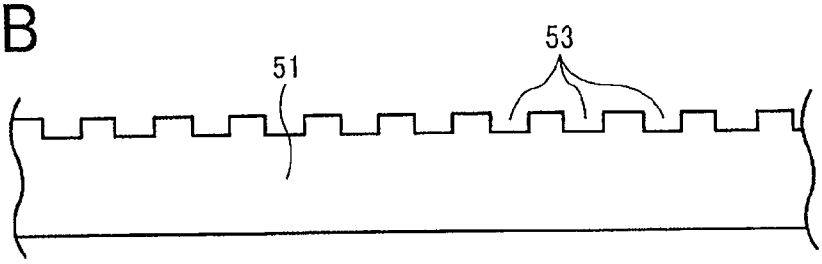
Figure 13C:
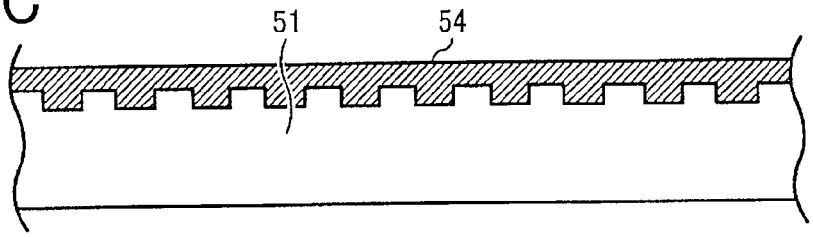
Figure 13D:
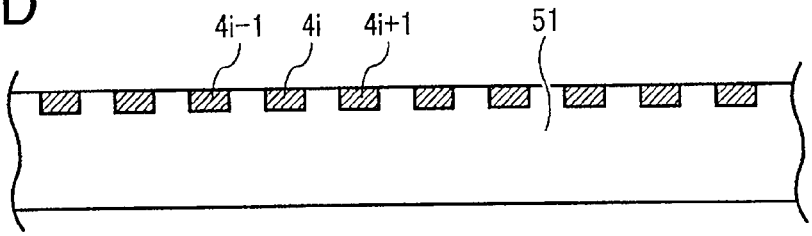
Figure 13E:
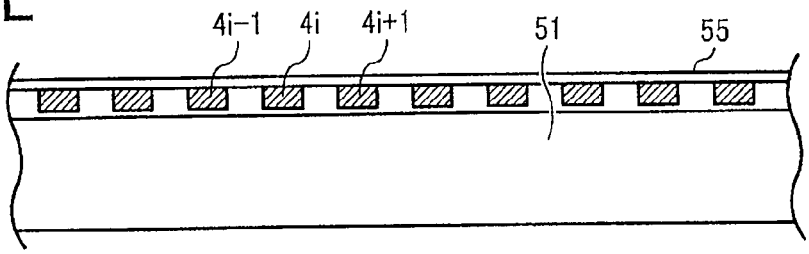
Figure 14:
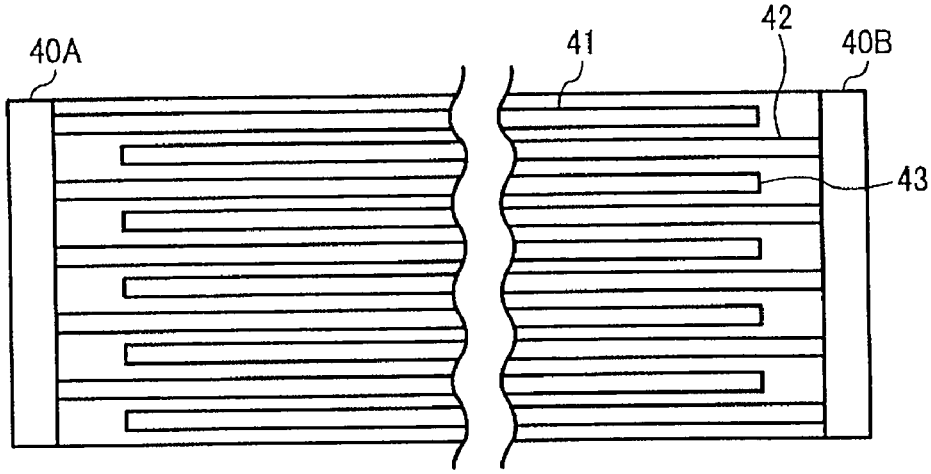
FIG. 14 illustrates the exemplary toner-carrying member when extended flat.

As shown in FIG. 12A, the toner-carrying roller 31 includes a cylinder 51 made of acrylic acid resin as an insulation member having plural shaft holes 52. To the shaft holes 52, plural electrode shafts 40A and 40B made of stein-less material as shown in FIG. 12C are pressure inserted as shown in FIG. 12B. Thus, the electrode shafts 40A and 40B are connected to the odd and even electrode groups 41, 43, and so on, and 42, and so on, respectively. The pattern electrode is formed in the respective steps as shown in FIGS. 13A to 13E. FIGS. 13A to 13E collectively illustrate the surface of the toner-carrying roller 31 when expanded in a peripheral direction. In the steps of FIG. 13A, the surface of the roller 51 obtained by the process illustrated in FIG. 12 is smoothly finished by means of peripheral planning. In the step of FIG. 13B, plural grooves 53 are scraped off to have a width of 50micrometer at an interval of 100 micrometer. In the step of FIG. 13C, the roller 51 subjected to the groove scraping is subjected to plating of non-electrolytic nickel 54. In the step of FIG. 13D, a needless conductive film is removed by planning the periphery of the toner-carrying roller 31 subjected to the plating of the non-electrolytic nickel.54. At this moment, the electrodes 41, 42, and 43 and so on, are formed mutually insulated to each other at the grooves 53. Then, by coating the roller 51 with silicone resin, the surface of the roller 51 is smoothed. At same time, a surface protection layer having a thickness of 5 micrometer and a cubic resistance rate of about $10^{10}$ ohm×cm is formed, so that the toner carrying roller 31 is produced. FIG. 14 illustrates the toner-carrying roller 31 when expanded flat.

Similar to the substrate 4, the toner-carrying roller 31 includes a protection layer 55 with a toner layer on it. Thus, when an alternating current voltage serving as a bias voltage is applied from the alternating current source via the electrode blush or the like to the electrode shafts 40A and 40B, toner performs a motion of hopping or flare by reciprocating between the odd and even number electrode groups 41, 43, and o on, and 42, and so on. When the following relation is established, the flare starts activating, wherein (Vmax(V)) represents an absolute value of a difference between a plus side peak and a minus side peak of the alternating current voltage applied from the alternating current source between the electrodes 41, 42, and so on;

$$V\max(V)/p(\text{micrometer})>1.$$

The flare becomes completely active when the following relation is established;

$$V\max(V)/p(\text{micrometer})>3.$$

Further, similar to the substrate 4, the surface layer 55 of the toner-carrying roller 31 preferably includes a cubic resistance rate of 10.sup.9 to 10.sup.12 (Ohm×cm), and is made of silicone resin. The material of the surface layer 55 is preferably capable of applying normal electric charge to toner when conflicting with the toner, and preferably includes glass or material used for a two-component developer carrier coat. As mentioned above, the electrode interval p is smaller than the developer gap d as defined by the following inequality;

$$p<d.$$

Figure 15:
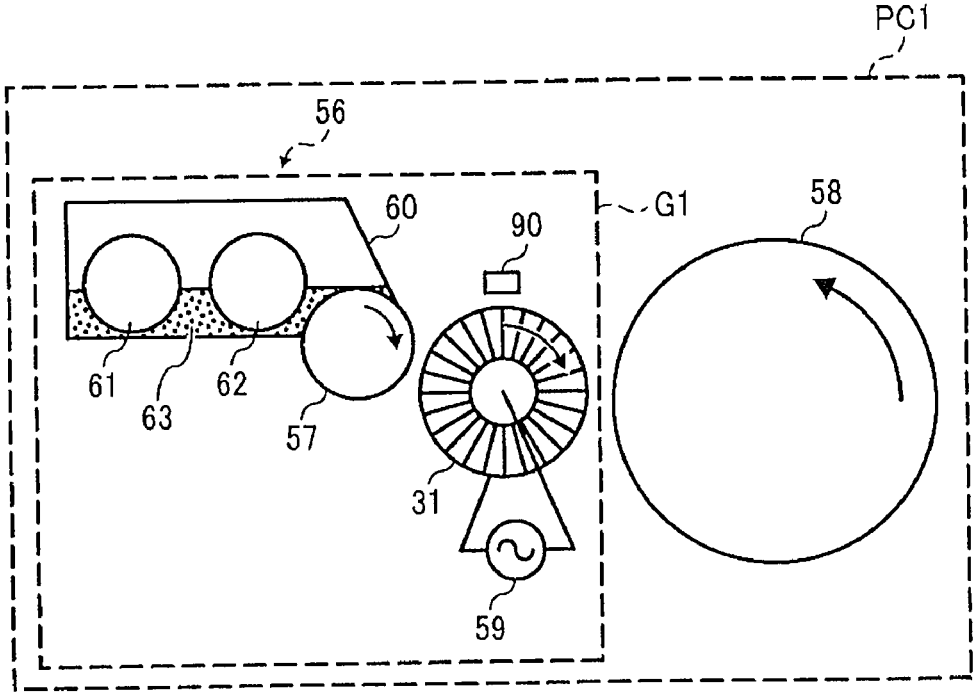
FIG. 15 illustrates an exemplary image forming apparatus according to the second embodiment of the present invention.

Now, a second embodiment of the present invention is described with ref to FIG. 15. As shown, the embodiment includes an image forming apparatus having a developing device using the above-mentioned toner-carrying roller 31. An ear of two-component developer of a conventional two component-developing member 56 contacts a toner carrying roller 31. The two component developer is obtained by blending magnetic carrier powder having particle diameter of 50 micrometer and polyether toner having particle diameter of 6 micrometer at a weight ratio of 7 to 8 (wt %), and is conveyed by a magnetic sleeve 57 of the two component developing member 56 installing a permanent magnet until the toner carrying roller 31. Then, the toner is partially transferred to a toner-carrying roller 31 by a direct current bias voltage applied between the magnet sleeve 57 and the toner-carrying roller 31. The toner transferred onto a toner carrying roller 31 is further transferred to a position to oppose the latent image carrier 58 while forming flare thereon when the toner carrying roller 31 is driven rotated by a driving section, not shown. Due to a difference between an average voltage of the surface of the toner carrying roller 31 and a voltage of the latent image carrier member 58, the toner is attracted to a latent image on the latent image carrier 58, so that the latent image carrier is developed and a toner image is formed. Between electrode shafts 40A and 40B, an alternating current voltage is applied as a bias voltage from the alternating current power source 59 serving as a voltage supplying device by means of an electrode brush or the like. Thus, a voltage difference is periodically created between odd and even number electrode groups 41, 41, and so on, and 42 and so on, respectively.

The toner not having contributed to the development returns from the developing section to the magnet sleeve 57. Since the flare is formed, an attraction force of the toner to the toner-carrying roller 31 is extraordinary weak, the toner returned from the developing section by the toner-carrying roller 31 is readily scraped off or uniformed by the ear of the two-component developer following the rotation of the magnet sleeve 57. By repeating this operation, an almost constant amount of toner flare is formed on the toner-carrying roller 31. The two-component developing member 56 stirs, conveys, and circulates the two-component developer 63 in the device 60. The magnetic sleeve 57 partially conveys the two-component developer to the toner-carrying roller 31 and returns the developer not having contributed to development. In the vicinity of the toner-carrying member 31, a toner amount-detecting device 90 is arranged to detect an amount of toner on the toner-carrying member 31. The toner amount-detecting device 90 includes an optical sensor and detects a toner weight by measuring intensity of light reflected from the surface of the toner-carrying member 31. The two-component developing member 56, the toner carrying member 31, the alternating current power source 59, and the toner amount-detecting device 90 collectively constitute a developing device G1. The developing device G1 constitutes a process cartridge PC1 with the latent image carrier 58 and the process cartridge PC1 is detachable to an image forming apparatus, not shown.

Now, latent image formation on an organic photoconductive member as a latent image carrier member 58 having a thickness of 13 micrometer using a laser writing system of 1200 dpi is described. The photoconductive member 58 is driven rotated by a driving section, not shown, and is uniformly charged by a charging device. A latent image is then formed when the laser writing system serving as an exposure device executes exposure. Such a latent image is formed under conditions that a charge voltage on the photoconductive member 58 ranges from about −500v to −300v and a writing voltage is about −50v at a solid section.

The latent image becomes a toner image on the toner-carrying member 31 when developed with the toner forming the flare. Conditions enabling reproduction of a dot of 1200 dpi and fine filling into a solid section while prevention from stein in a background are considered using toner having a particle diameter of 6 micrometer with a charge of about −22 microC/g, and are found as mentioned below. Specifically, a gap between the toner carrying member 31 and the photoconductive member 58 is about 500 micrometer, and an alternating current bias having peaks at −400 and zero volts (i.e., an average voltage of −200V) at every moment and is applied to each of odd and even number electrode groups of the toner carrying member 31 from the alternating current power supply 59 at a frequency of 2 kHz. The alternating current biases to the odd and even number electrode groups have opposite phases to each other. At this moment, a line speed of a latent image carrier 58 is 200 mm/s, and a nip width is about 2 mm when measured by the above-mentioned manner. When r=2, Vp=200, n=2, and f=2k are substituted in the formula (1), respectively, the formula is satisfied when h equals 40. Specifically, it indicates a condition where a uniform image can be obtained.

Although not shown, the toner image on the latent image carrier 58 is transferred onto a recording member such as a recording sheet fed from a sheet feeding devices. The recording sheet is fixed by a fixing device into the recording member, and is finally ejected outside.

Figure 16:
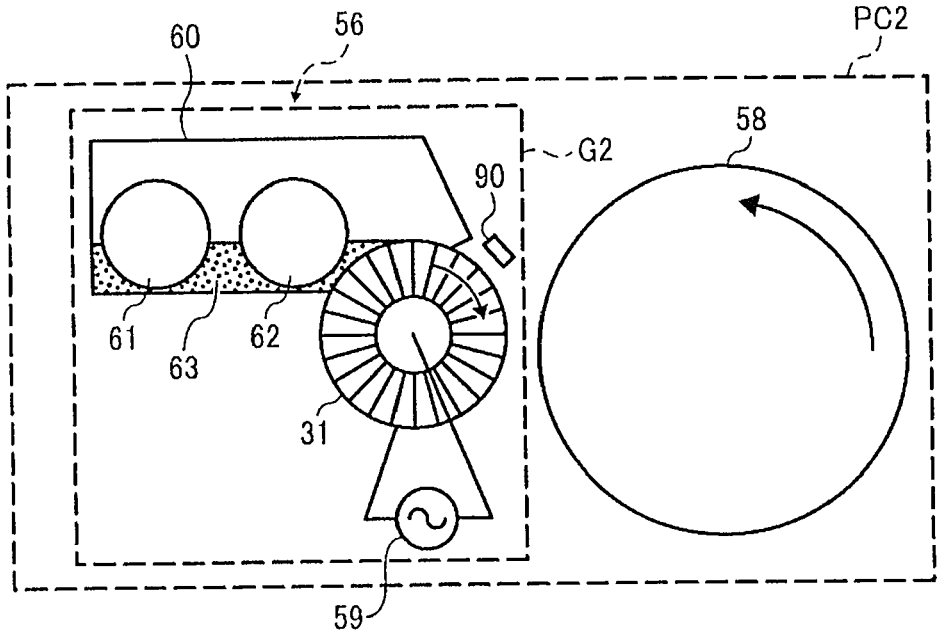
FIG. 16 illustrates an exemplary image forming apparatus according to the third embodiment of the present invention.

Now, a third embodiment is described with ref to FIG. 16. This embodiment omits the magnetic sleeve 57 described with ref to FIG. 15, thereby having a simplified configuration. A cascade developing is executed to supply toner of two-component developer to the toner-carrying roller 31. Since the developing device 56 forms a thin toner layer on the toner carrying roller 31 using a simple cascade, a rate of toner transfer to the toner-carrying roller 31 decreases in comparison with the embodiment of FIG. 15.

However, a rotation speed of the toner-carrying roller 31 is increased in accordance with an amount of the decrease to handle a developing speed needed for the photoconductive member. Since a developing device including the two-component developing member 56 and the toner carrying roller 31 excluding the magnetic sleeve 57 is substantially the same size as a conventional two component-developing device, a compact image formation engine of high quality can be obtained. Thus, according to this embodiment, a higher quality image can be obtained with a more compact device than the conventional one. Specifically, the two-component developing member 56, the toner carrying member 31, the alternating current power source 59, and the toner amount detecting device 90 collectively constitute a developing device G2. The developing device G2 then constitutes a process cartridge PC2 detachable to an image forming apparatus, not shown, together with a latent image carrier member 58.

Figure 17:
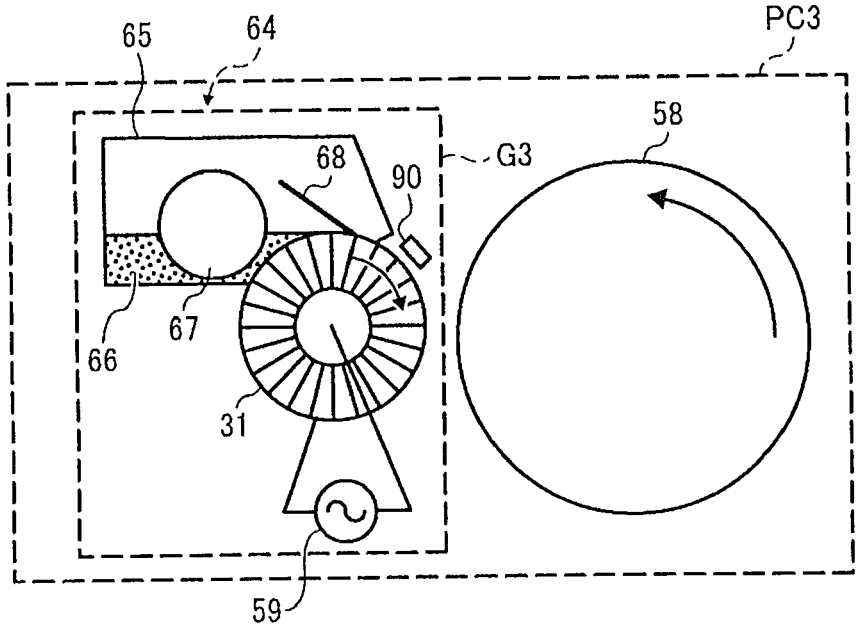
FIG. 17 illustrates an exemplary image forming apparatus according to the fourth embodiment of the present invention.

Now, a fourth embodiment is described with ref to FIG. 17. In this embodiment, instead of the two component developing member 56 of FIG. 15, an one component developing member 64 storing one component developer only having toner is used. The one-component developing member 64 transfers the toner to the toner-carrying roller 31 and forms a thin toner layer thereon. Specifically, the one component developing member 64 causes a circulation paddle 67 to stir the toner 66 in the device 65 and supplies the toner to the toner-carrying roller 31 while circulating the toner. A metering blade 68 serving as a toner adjustment member adjusts a thickness of the toner to be a prescribed level thereby forming a thin toner layer.

This embodiment is inferior to those described with ref to FIGS. 15 and 16 in the viewpoint of stability of toner supply to the toner carrying roller 31. However, this problem can be resolved if conditions are finely adjusted. As a result, the embodiment can provide a significantly light and compact developing device that can obtain a high quality image. Then, according to this embodiment, a higher quality image can be obtained with a more compact device than the conventional one. Specifically, the one component developing member 64, the toner carrying member 31, the alternating current power source 59, and the toner amount detecting device 90 collectively constitute a developing device G3. The developing device G3 constitutes a process cartridge PC3 detachable to an image forming apparatus, not shown, together with the latent image carrier 58 to be.

Figure 18:
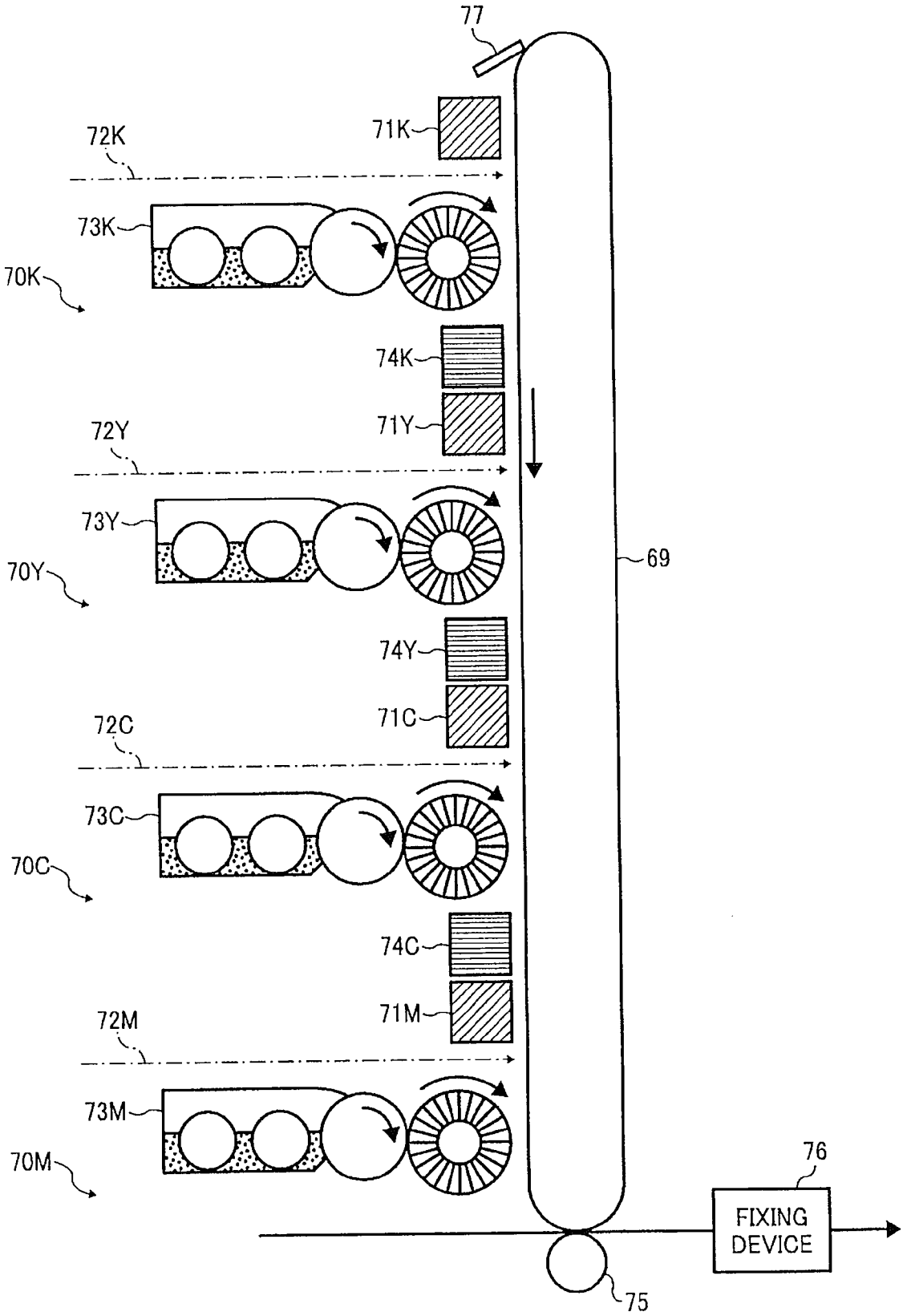
FIG. 18 illustrates an exemplary image forming apparatus according to the fifth embodiment of the present invention.

Now, a fifth embodiment is described with reference to FIG. 18. In this embodiment, an image forming apparatus forms a color image by overlying plural color toner images on a photoconductive member, and includes a developing device having the two component developing member 56 and the toner carrying roller 31 as described with reference to FIG. 15. A belt state organic photoconductive member 69 serving as a latent image carrier is suspended around a pair of rollers, not shown, and is driven by a driving section, not shown. On the left side of the photoconductive member 69, plural image formation devices 70K, 70Y, 70C, and 70M are arranged for forming black, yellow, cyan, magenta images, respectively. The photoconductive member 69 is initially charged uniformly by a charge device 71K at the image forming device 70K. Then, a writing device serving as an exposure device exposes with an optical beam 72K modulated by image data for black color, so that a latent image is formed on the photoconductive member. The latent image is developed by the developing device 73*k* having the same configuration to that as described with reference to FIG. 15, thereby becoming to a black toner image. Then, a charge remover 74K removes charge remaining on the photoconductive member 69, so that the photoconductive member is ready for the next image formation.

The photoconductive member 69 is then uniformly charged by a charge device 71Y at the image forming apparatus 70Y. Then, a writing device, not shown, serving as an exposure device exposes with an optical beam 72Y modulated by image data for yellow color, so that a latent image is formed on the photoconductive member. The latent image is developed by the developing device 73Y having the same configuration to that described with reference to FIG. 15, thereby becoming to a yellow toner image that overlies the black toner image. Then, a charge remover 74K removes charge remaining on the photoconductive member 69, so that the photoconductive member is ready for the next image formation.

The photoconductive member 69 is then uniformly charged by a charge device 71C at the image forming device 70C. Then, a writing device, not shown, serving as an exposure device exposes with an optical beam 72C modulated by image data for cyan color, thereby, a latent image is formed on the photoconductive member. The latent image is developed by the developing device 73C having the same configuration to that described with reference to FIG. 15, thereby becoming to a cyan toner image that overlies the yellow toner image. Then, a charge remover 74C removes charge remaining on the photoconductive member 69, so that the photoconductive member is ready for the next image formation.

The photoconductive member 69 is then uniformly charged by a charge device 71M at the image forming device 70M. Then, a writing device, not shown, serving as an exposure device exposes with an optical beam 72M modulated by image data for magenta color, so that a latent image is formed on the photoconductive member. The latent image is developed by the developing device 73M having the same configuration to that described with reference to FIG. 15, thereby becoming to a magenta toner image that overlies the cyan toner image.

A recording member such as a recording sheet is fed from a sheet-feeding device. The full color image is transferred from the photoconductive drum 69 onto the recording member by a transfer roller 75 serving as a transfer device receiving a transfer bias from a power source. The full color image on the recording member is fixed by a fixing device 76 there onto, and the recording member is ejected outside. Toner or the like remaining on the photoconductive member 69 is removed by a cleaner 77 serving as a cleaning device after the full color transfer process. The above-mentioned developing devices 73K to 73M can employ the two component-developing member 56 and the toner carrying roller 31 of FIG. 16 or the one component developing member 64 and the toner carrying roller 31 of FIG. 17.

According to this embodiment, since writing of four colors is executed onto the common photoconductive member, a positional deviation does not occur on principle in comparison with an ordinary tandem type. Thus, colors can be superimposed on the photoconductive member without positional deviation, so that a high quality full color image can be obtained. Further, by using the above-mentioned developing device, a high quality image formation process can be stably executed for long tome. Because, a toner image once formed on the photoconductive member 69 is not interrupted while avoiding scavenging and color blending.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A developing device configured to develop a latent image, comprising:

a latent image carrier configured to carry a latent image;

a toner carrier configured to carry toner and develop the latent image, said toner carrier being arranged opposing the latent image carrier;

at least two electrodes configured to create an electric field therebetween, said at least two electrodes being arranged in a prescribed direction insulated from each other on a surface of the toner carrier; and an alternating voltage supplying device configured to supply n number of phases ($n \geqq 2$) of an alternating voltage to the at least two electrodes, respectively, said alternating voltage changing the electric field to cause toner to hop and form toner cloud on the surface of the toner carrier; wherein said toner hopping is halted at a prescribed time period during the toner cloud formation, said alternating voltage is supplied a prescribed times "m" in a cycle T1 per cycle T2, T2>Ti×m, r represents a width of a developing nip where the latent image carrier and the toner carrier oppose each other to develop the latent image in a moving direction of the latent image carrier, h represents a parameter, and Vp represents a line speed of the latent image carrier, and $$r/Vp = h \times 1/n \times T2/m$$

$$(1 < h < 400).$$

2. The developing device as claimed in claim 1, wherein the relation T2 >T1×m is established when a prescribed point on the surface of the latent image carrier passes through a developing nip where the latent image carrier and toner carrier oppose each other to execute development.

3. The developing device as claimed in claim 1, wherein said n number of phases of the alternating voltage are different from each other and generated at the same time.

4. The developing device as claimed in claim 1, wherein 1<h<300.

5. The developing device as claimed in claim 1, wherein the interval (T2−T1 ×m) is equal to or longer than a toner hopping average time period when toner peeled off a prescribed electrode sticks to the other electrode.

6. The developing device as claimed in claim 1, wherein T1×m/T2×100<50.

7. The developing device as claimed in claim 1, wherein T1×m/T2×100<40.

8. The developing device as claimed in claim 1, wherein Vmax(v) represents an absolute value of a voltage difference between the neighboring electrodes, and p (micrometer) represents an interval between the neighboring electrodes in a moving direction of the latent image carrier, and Vmax/p >1.

9. The developing device as claimed in claim 8, Vmax/p >3.

10. The developing device as claimed in claim 1, wherein d represents a distance between the latent image carrier and the toner carrier in a developing nip, and p (micrometer) represents an interval between the neighboring electrodes in a moving direction of the latent image carrier, and d>p.

11. The developing device as claimed in claim 1, further comprising a developing member configured to supply toner to the toner carrier, said developing member storing two-component toner.

12. The developing device as claimed in claim 1, further comprising a developing member configured to supply toner to the toner carrier, said developing member storing one-component toner.

13. A process cartridge comprising a latent image carrier and a developing device as claimed in claim 1, said process cartridge being detachable to an image forming apparatus.

14. An image forming apparatus comprising a process cartridge as claimed in claim 13.

15. An image forming apparatus comprising at least two process cartridges as claimed in claim 13, wherein color superposition is executed at least twice on the latent image carrier.

16. An image forming apparatus comprising a developing device as claimed in claim 1.

17. The developing device as claimed in claim 1, wherein a frequency of the alternating voltage is about 0.1 to about 3 kHz.

18. The developing device as claimed in claim 1, wherein 20<T1×m/T2×100 <40.

19. The developing device as claimed in claim 1, wherein said developing device stores one component developer.

20. The developing device as claimed in claim 1, wherein said developing device includes a blade to adjust a thickness of a toner layer on the toner carrier.

* * * * *